US006200184B1

(12) United States Patent
Rich et al.

(10) Patent No.: US 6,200,184 B1
(45) Date of Patent: Mar. 13, 2001

(54) BUBBLE MAKER TOY

(75) Inventors: Ronald Rich, Burton, OH (US); Donald A. Marini, Sonoma; Bill James Cajka, Redondo Beach, both of CA (US)

(73) Assignee: Oddzon, Inc., Napa, CA (US)

( * ) Notice: Subject to any disclaimer, the term of this patent is extended or adjusted under 35 U.S.C. 154(b) by 0 days.

(21) Appl. No.: 09/183,815

(22) Filed: Oct. 30, 1998

(51) Int. Cl.[7] ..... A63H 33/28

(52) U.S. Cl. ..... 446/15; 446/16; D21/401; D21/402

(58) Field of Search ..... 446/15, 16, 17, 446/18, 19, 20, 21; 40/408; D21/401, 402

(56) References Cited

U.S. PATENT DOCUMENTS

| | | | | |
|---|---|---|---|---|
| D. 263,062 | * | 2/1982 | Rasmussen | D21/61 |
| D. 353,166 | | 12/1994 | Kwak | D21/61 |
| 1,995,108 | * | 3/1935 | Schoepe . | |
| 2,412,732 | * | 12/1946 | Holman . | |
| 2,547,825 | * | 4/1951 | King . | |
| 3,064,387 | * | 11/1962 | Campbell . | |
| 3,100,947 | | 8/1963 | Hellman | 46/8 |
| 3,228,136 | | 1/1966 | Rouse | 46/8 |
| 3,708,909 | * | 1/1973 | Winston . | |
| 3,861,076 | | 1/1975 | Starr | 46/6 |
| 3,950,887 | | 4/1976 | Kort | 46/6 |
| 4,044,496 | | 8/1977 | Jernstrom | 46/7 |
| 4,045,049 | | 8/1977 | Schultz | 280/289 R |
| 4,246,717 | | 1/1981 | Wachtel | 46/6 |
| 4,299,049 | | 11/1981 | Pimentel et al. | 46/8 |
| 4,481,731 | | 11/1984 | La Fata et al. | 446/15 |
| 4,556,392 | | 12/1985 | Chang | 446/16 |
| 4,764,141 | | 8/1988 | D'Andrade | 446/16 |
| 5,078,636 | | 1/1992 | Clarke et al. | 446/15 |
| 5,269,715 | * | 12/1993 | Silveria et al. | 446/16 |
| 5,297,979 | | 3/1994 | Amron | 446/16 |
| 5,366,402 | | 11/1994 | Rudell et al. | 446/16 |
| 5,462,469 | | 10/1995 | Lei | 446/15 |
| 5,495,876 | * | 3/1996 | Schramm | 141/98 |
| 5,498,191 | | 3/1996 | DeMars | 446/15 |
| 5,613,890 | | 3/1997 | DeMars | 446/15 |
| 5,643,035 | | 7/1997 | Freese et al. | 446/15 |
| 5,908,057 | * | 6/1999 | Schramm | 141/98 |

* cited by examiner

*Primary Examiner*—Jacob K. Ackun
*Assistant Examiner*—Bena B. Miller
(74) *Attorney, Agent, or Firm*—Laff, Whitesel & Saret, Ltd.

(57) ABSTRACT

A bubble maker toy for producing a plurality of bubble streams from a liquid bubble solution. The bubble maker toy comprises a bubble wand and an electric fan. The bubble wand includes a plurality of bubble rings connected together by connection arms. The electric fan is configured for producing an airflow concentrated adjacent to the center of the bubble wand which forces the bubble streams outward from the center of the bubble wand and away from each other. The connection arms are arcuate in shape and connected to each other at approximately the center of the bubble wand causing the air flow produced by the electric fan to swirl in a rotating manner further forcing the bubble streams away from each other thus preventing the bubbles from sticking together or combining to form a cluster of bubbles.

18 Claims, 4 Drawing Sheets

BUBBLE MAKER TOY

FIELD OF THE INVENTION

The present invention relates to bubble maker toys. More particularly, the present invention relates to bubble maker toys for simultaneously producing a plurality of bubble streams.

BACKGROUND INFORMATION

The art of making bubbles from a soap solution is a well-known form of entertainment. Typically, a bubble wand having a generally circular bubble ring at one end of the wand is immersed in a soap solution or the like of suitable viscosity and surface tension to create an adherent layer of soap solution. The soap solution forms a film which typically spans the entire inner area of the bubble ring. The bubble ring is then blown against to create bubbles. One disadvantage of this technique is that when a user blows against the bubble ring, a user must place his mouth on or about the bubble ring. This is a problem, particularly when there are many users operating the device, because it promotes the spread of germs among users.

Bubble maker toys have been made that provide a fan for producing an airflow against the bubble wand. However, these fans are typically made of a hard plastic material that presents additional safety concerns. For example, a child using the toy could stick his finger in the fan blades while they are rotating causing injury to the child's fingers.

Prior art bubble maker toys have been made which have multiple bubble rings on a single bubble wand for producing multiple bubbles simultaneously. Additionally, bubble maker toys have been produced which create a stream of bubbles. However, problems are encountered when attempting to produce multiple bubble streams. Such problems include having the multiple bubbles stick together or combine to form one cluster of bubbles.

Thus, there is a need for a bubble maker toy having an improved, safe air flow means. There is also a need for a bubble maker toy that can produce multiple streams of bubbles simultaneously and which retains their separate integrities.

SUMMARY OF THE INVENTION

The bubble maker toy of the present invention satisfies these needs and other needs. A bubble maker toy according to the present invention is configured for simultaneously producing a plurality of bubble streams from a liquid bubble solution. The bubble maker toy comprises a bubble wand having a center and an outer circumference, the bubble wand including a plurality of bubble rings arranged around the outer circumference, and air flow means for producing an air flow across the bubble wand and through the bubble rings.

The bubble solution is of suitable viscosity and surface tension to cling to the bubble wand forming films across the bubble rings. The air flow across the bubble wand and through the bubble rings produces bubble streams from the bubble solution. The air flow means is configured for producing an air flow which forces the bubbles streams outward from the center of the bubble wand and away from each other preventing them from sticking together or combing to form one cluster of bubbles.

The airflow means is configured for producing an air flow which is concentrated adjacent to the center of the bubble wand. The bubble wand further comprises connection arms which connect the bubble rings together. The connection arms are arcuate in shape and are connected to each other at approximately the center of the bubble wand. The air flow produced by the air flow means flows across the connection arms causing the air flow to swirl in a rotating manner further forcing the bubble streams outward from the center of the bubble wand and away from each other. Preferably, the bubble rings and connection arms include ridges which form reservoirs for holding the bubble solution.

The airflow means comprises an electric fan having a plurality of fan blades configured to rotate about a central axis. The fan blades include upper, outer edges which curve inward toward the central axis for producing the airflow concentrated adjacent to the center of the bubble wand. The bubble wand is positioned adjacent to the fan blades with the bubble rings positioned adjacent to the upper, outer edges of the fan blades. Preferably, the fan blades are comprised of a soft foam material for preventing injuries to the toy user's fingers.

The bubble maker toy further comprises a housing having a handle. The electric fan and bubble wand are connected to said housing. Two activation switches are included for activating the electric fan. The activation switches are positioned on opposite ends of the handle so that the bubble maker toy can be easily operated by both right- and left-handed users.

A bubble solution dipping dish is included for holding the bubble solution. In operation, the bubble wand is dipped into bubble solution held in the dipping dish prior to activating the electric fan. The dipping dish includes a sidewall having a pouring spout for returning unused bubble solution to a storage container.

Further objects, features and advantages of the present invention will become apparent from the following description and drawings.

DETAILED DESCRIPTION OF THE PREFERRED EMBODIMENT

Figure 1:
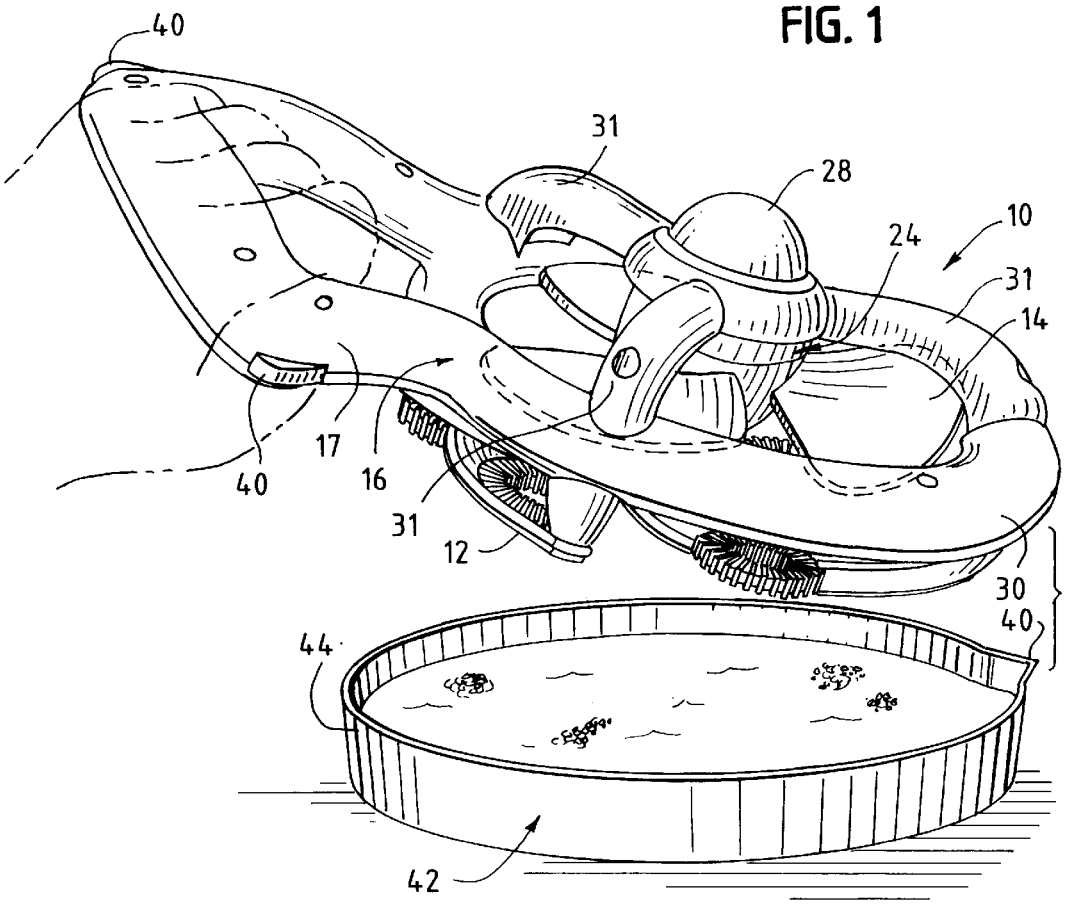
FIG. 1 is a perspective view of a bubble maker toy and dipping dish according to the present invention.

In accordance with the present invention, a bubble maker toy is described that provides distinct advantages when compared to those of the prior art. The invention can best be understood with reference to the accompanying drawing figures.

Referring now to the drawings, and especially to FIGS. 3, 4, 6 and 7, a bubble maker toy according to the present invention is generally designated by reference numeral 10. The bubble maker toy 10 comprises a bubble wand 12 and an airflow means, such as an electric fan 14, connected to a housing 16. The housing 16 includes a handle 17 such that the bubble maker toy 10 can be operated as a hand-held device.

The bubble wand 12 includes a plurality of bubble rings 18 connected together by connection arms 20. The connection arms 20 are arcuate in shape and connected together adjacent the center of the bubble wand 12. Preferably, the upper outer face of the bubble rings 18 and connection arms 20 includes raised ridges 22. As will be discussed in more detail below, the spaces between the raised ridges 22 act as reservoirs for holding bubble solution.

The electric fan 14 includes a battery-operated electric motor 24 and a fan blade assembly 25 including a plurality of fan blades 26 configured to rotate about a central axis. Preferably, the fan blades 26 are made of a soft foam material such as polyurethane. The soft foam material is pliable and thus will not injure a child's fingers. In the preferred embodiment, the electric motor 24 comprises a 3 volt permanent magnet motor.

The fan blades 26 are connected to a central hub 27 at an angle of approximately 45° from horizontal. The upper, outer edges 29 of the fan blades 26 are curved inward to create an airflow concentrated adjacent to the central hub 27. In the preferred embodiment, the fan blades 26 are stamped from a sheet of soft foam material. The fan blades 26 are formed together on a single piece of soft foam material with the fan blades 26 integrally formed with and extending from a center section.

Preferably, three fan blades 26 are attached to the central hub 27. A fan blade assembly shaft 23 extends from the bottom of the fan blade assembly 25 and is used for connecting the fan blade assembly 25 to the electric motor 24. Preferably the central hub 27 is formed in two pieces which are secured together with fan blades 26 sandwiched between the two pieces and extending from the central hub 27. The central hub 27 and shaft 23 are made of a molded plastic material, however other suitable materials or manufacturing processes can be used. In the preferred embodiment, the fan blade assembly 25 measures 4½ inches across, the central hub 27 being 2 inches wide and 1¼ inches high and the fan blades 26 projecting outwardly from the hub in a radial direction of 1⅝ inches at their greatest projection.

The electric fan blade assembly 25 and bubble wand 12 are connected to the housing 16 adjacent to, and in an overlying relationship relative to, one another. In this position, the bubble rings 18 are located adjacent to the upper, outer edges 29 of the fan blades 26. In this manner, as discussed in more detail below, an airflow created by operation of the electric fan 14 is directed through the bubble wand 12 and through the bubble rings 18.

The housing 16 includes a handle 17, a motor enclosure 28 for motor 24 and a bubble wand mounting section 30. Preferably, the bubble wand mounting section 30 is circular in shape. The motor enclosure 28, is connected to the bubble wand mounting section 30 by spokes 31 and is in approximately the center and below the bubble wand mounting section 30. Spokes 31 form a fan blade cage. Preferably, the housing 16 is made of a molded plastic material, however other suitable materials or manufacturing processes may be used.

The fan blade assembly 25 is connected via shaft 23 to the electric motor 24 such that the fan blades 26 are positioned in the fan blade cage to rotate in approximately the same plane as the bubble wand connection section 30 with the upper, outer edges 29 of the fan blades 26 extending beyond the bubble wand connection section 30. The upper, outer edges of fan blades 26 preferably move closely adjacent to but spaced from the bubble rings 18. The bubble wand 12 is connected to the bubble wand connection section 30 by posts 32 formed integrally with the bubble wand 12. The posts 32 extend through spacers 34 into apertures in the bubble wand section 30. Fasteners, such as threaded screws 36, are used to secure the bubble wand 12 to the mounting section 30. The spacers 34 fit between the bubble wand 12 and the bubble wand mounting section 30 to hold the bubble wand 12 a predetermined distance away therefrom. In the preferred embodiment, the bubble wand 12 is spaced ½ inch from the bubble wand mounting section 30.

In the preferred embodiment, the bubble wand 12 comprises a molded plastic material, however other suitable materials or manufacturing processes may be used to make a bubble wand 12 according to the present invention. The bubble wand 12 includes six bubble rings 18 arranged around the outer circumference of the bubble wand 12 in a circular pattern. Three connection arms 20 connect the six bubble rings 18 together. The three connection arms 20 connect to each other in approximately the center of the bubble wand 12 adjacent to and centered relative to the central hub 27 of the fan blade assembly 25. Each connection arm 20 includes a connection stub 21, which is used, inter alia, for connecting the bubble wand 12 to the housing 16. The posts 32 extend from the bottom side of the outer ends of connection stubs 21 substantially perpendicular to the plane of the bubble wand 12.

In the preferred form shown in the drawings, the connection arms 20 comprise first segments 20A and second segments 20B. It is the first segments 20A which are connected and formed to each other adjacent the center of the bubble wand 12. Segments 20A extend outwardly and terminate at a first set of bubble rings 18. The second segments 20B are joined to respective ones of the first set of bubble rings 18 and extend to respective ones of the second set of bubble rings 18. In this manner, all of the bubble rings 18 are connected to each other. As shown, connection stubs 21 project outwardly from the first and second sets of bubble rings 18.

It will also be apparent from the drawings that the motor 24 drives the fan blades 26 in a clockwise direction, which is in the same direction as the arcuate connection arms 20 are arched. To produce the most effective swirling airflow pattern and repeated streams of bubbles the relationship of the curvature of the connector arms 20 and fan blade 26 direction should be as shown. If the fan blades 26 are to move in a counterclockwise direction, then the curvature of the connector arms 20 should be reversed so that the connector arm curvature is in the same direction as the fan blades 26 are driven.

In the preferred embodiment, the bubble rings 12 have an inner diameter of ¾ inch and an outer diameter of 1¼ inches. The centers of the bubble rings 12 are positioned approximately 2 inches from the center of the bubble wand 12 and approximately 2 inches from the adjacent bubble ring centers. The connection arms 20 are approximately ½ inch wide.

The housing handle 17 includes a battery compartment and textured grip 38. In the preferred embodiment, the battery compartment is configured to hold four AA (1.5 v) batteries, which are electrically connected to the electric motor 24, for powering the motor 24. A pair of activation switches 40 is positioned one each at opposite ends of the handle 17. The activation switches 40 are electrically connected to the electric motor 24 and are configured for activating the electric motor 24 which causes the fan blades 26 to rotate creating an air flow through the bubble wand 12 and through the bubble rings 18, as described in more detail below. By placing the activation switches 40 at opposite ends of the handle 17, the bubble maker toy 10 can be easily operated by both right- and left-handed users and whether it is gripped palm up or palm down.

A dipping dish 42 may be provided for holding the bubble solution. In the preferred embodiment, the dipping dish 42 comprises a circular flat dish slightly larger than the bubble wand 12. The dipping dish 42 has a raised sidewall 44 which includes a pouring spout 46 for returning unused bubble solution to a storage container. Preferably, the dipping dish 42 is made of a molded plastic material, however other suitable materials and manufacturing processes may be used. Whereas here the bubble wand has an outside diameter of about 6½ inches in the preferred embodiment, the dipping dish 42 has a diameter of approximately 7 inches and the sidewalls 44 are approximately ⅞ inches high.

Figure 2:
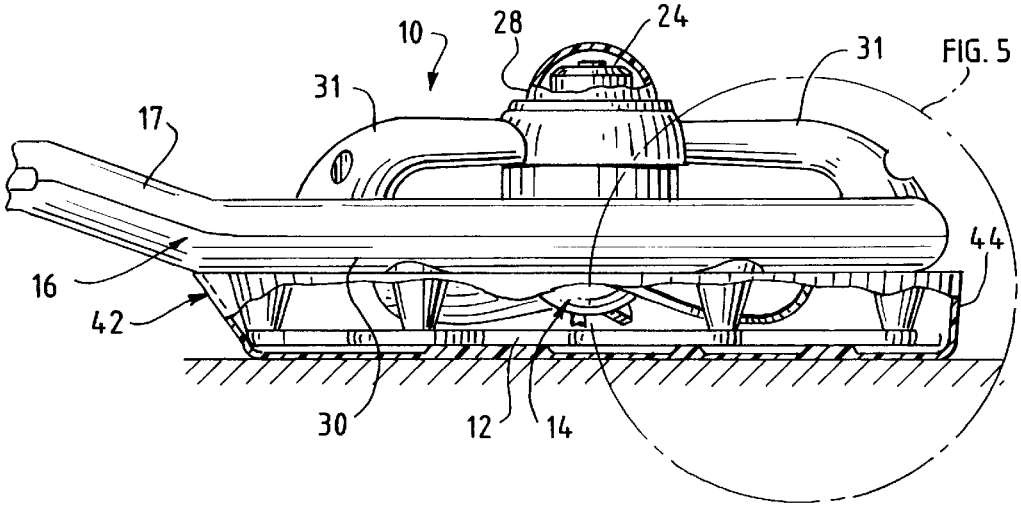
FIG. 2 is a side view, partially in section, of the bubble maker toy of FIG. 1 resting in the dipping dish of FIG. 1.
Figure 3:
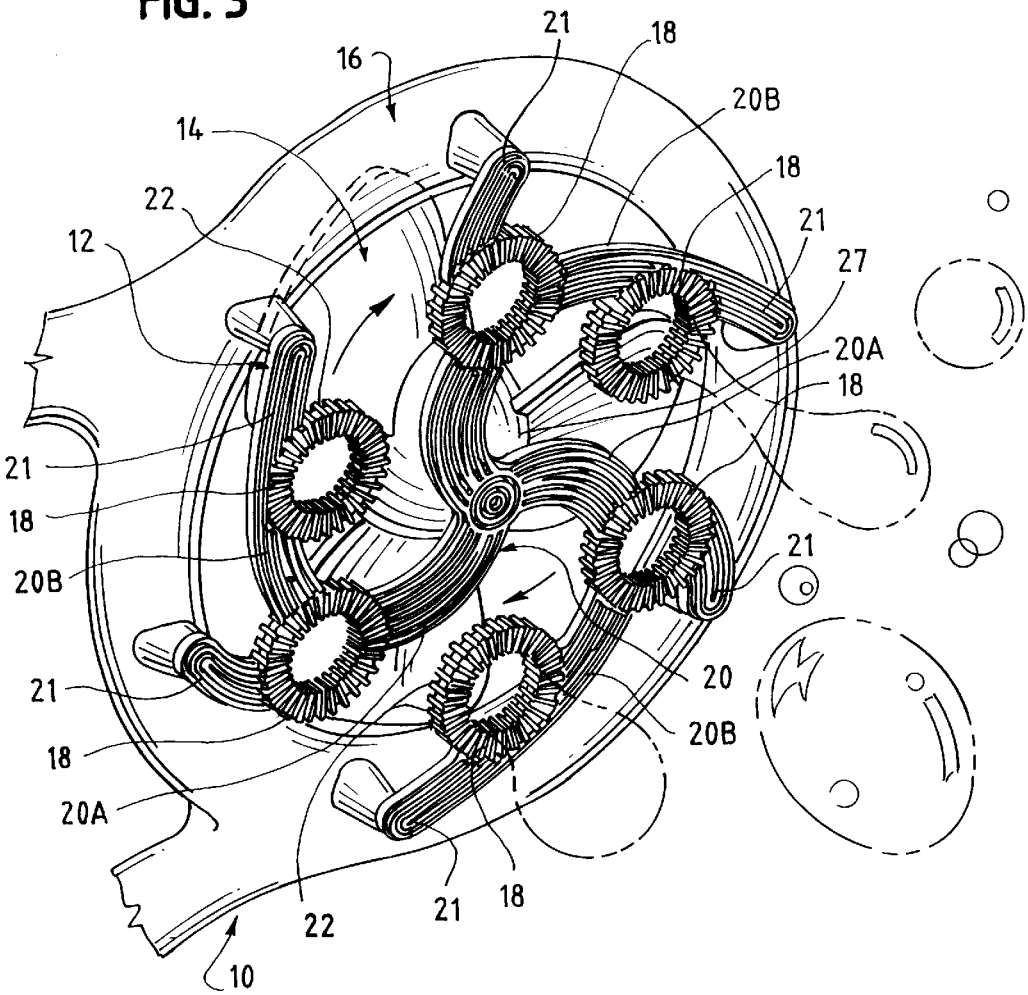
FIG. 3 is a perspective view of the bubble wand of the bubble maker toy of FIG. 1.
Figure 4:
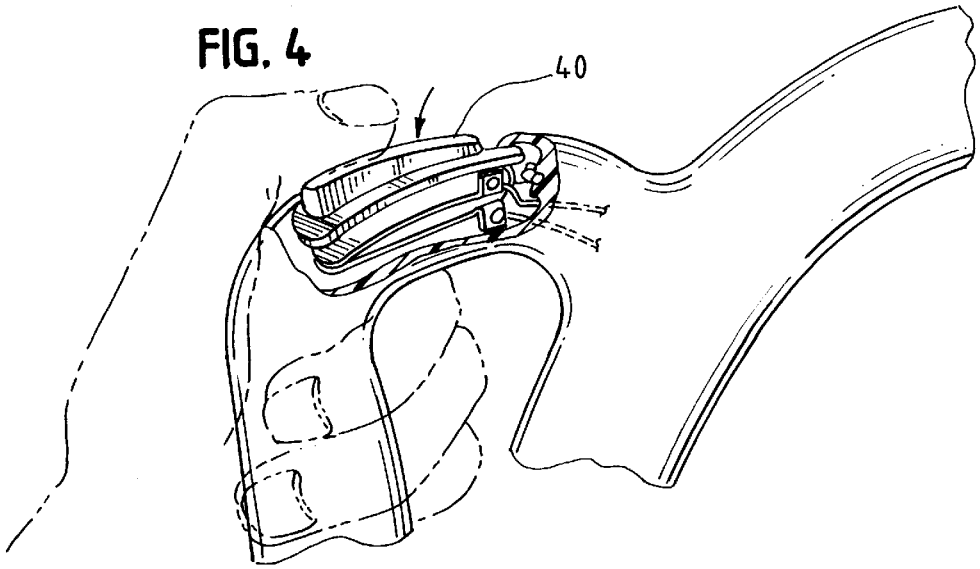
FIG. 4 is an enlarged sectional view of a handle and an activation switch of the bubble maker toy of FIG. 1.
Figure 5:
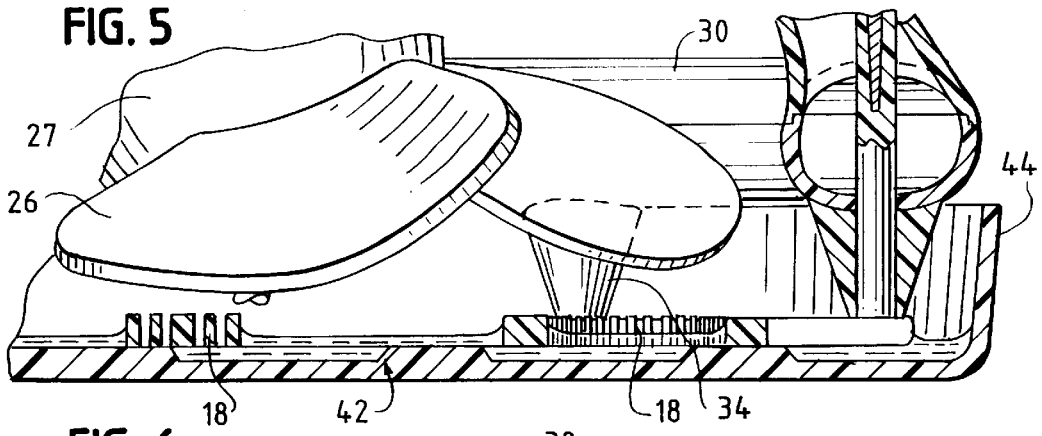
FIG. 5 is an enlarged cut-away view of the bubble maker toy and dipping dish of FIG. 2.
Figure 6:
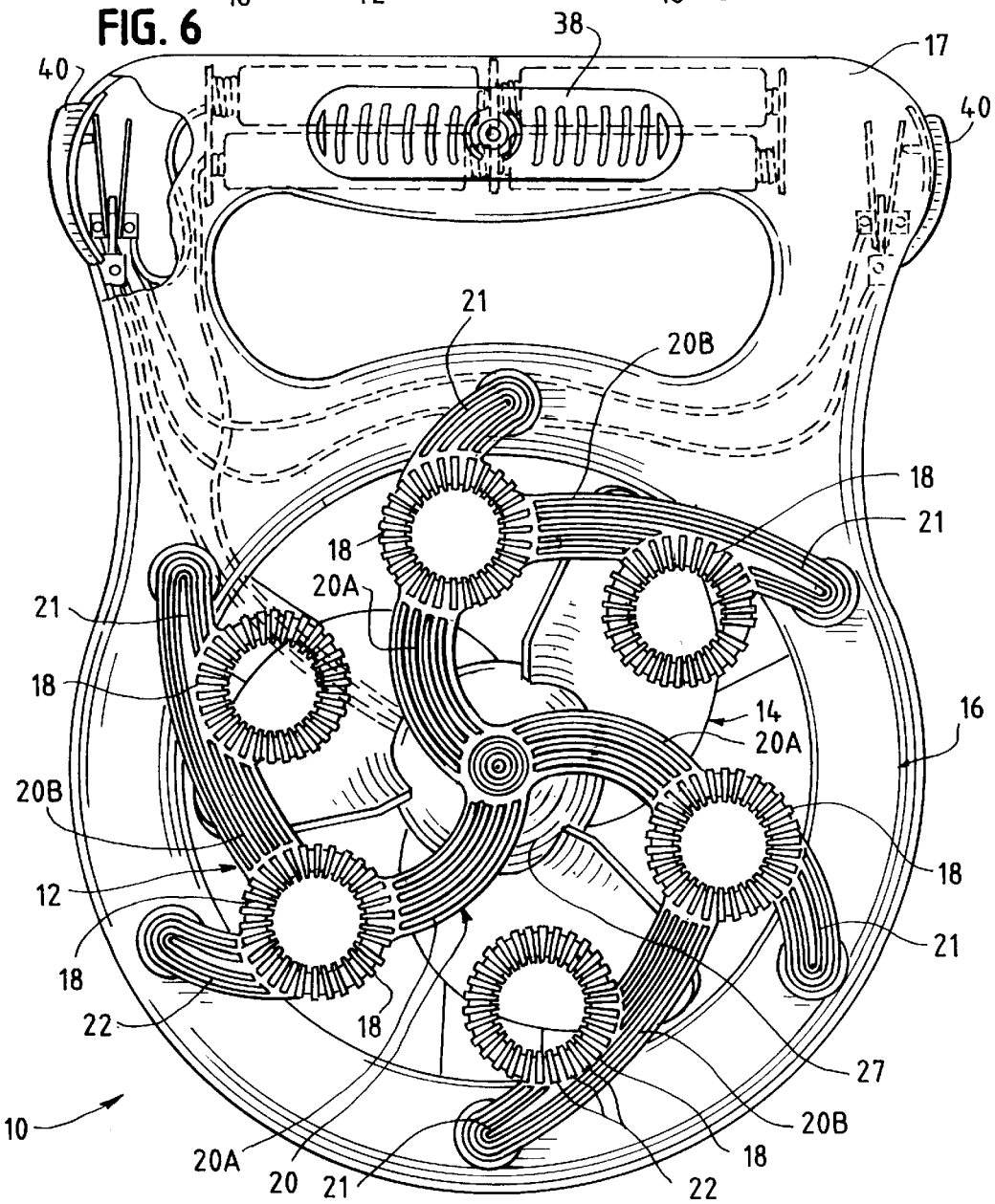
FIG. 6 is a top plan view of the bubble maker toy of FIG. 1.
Figure 7:
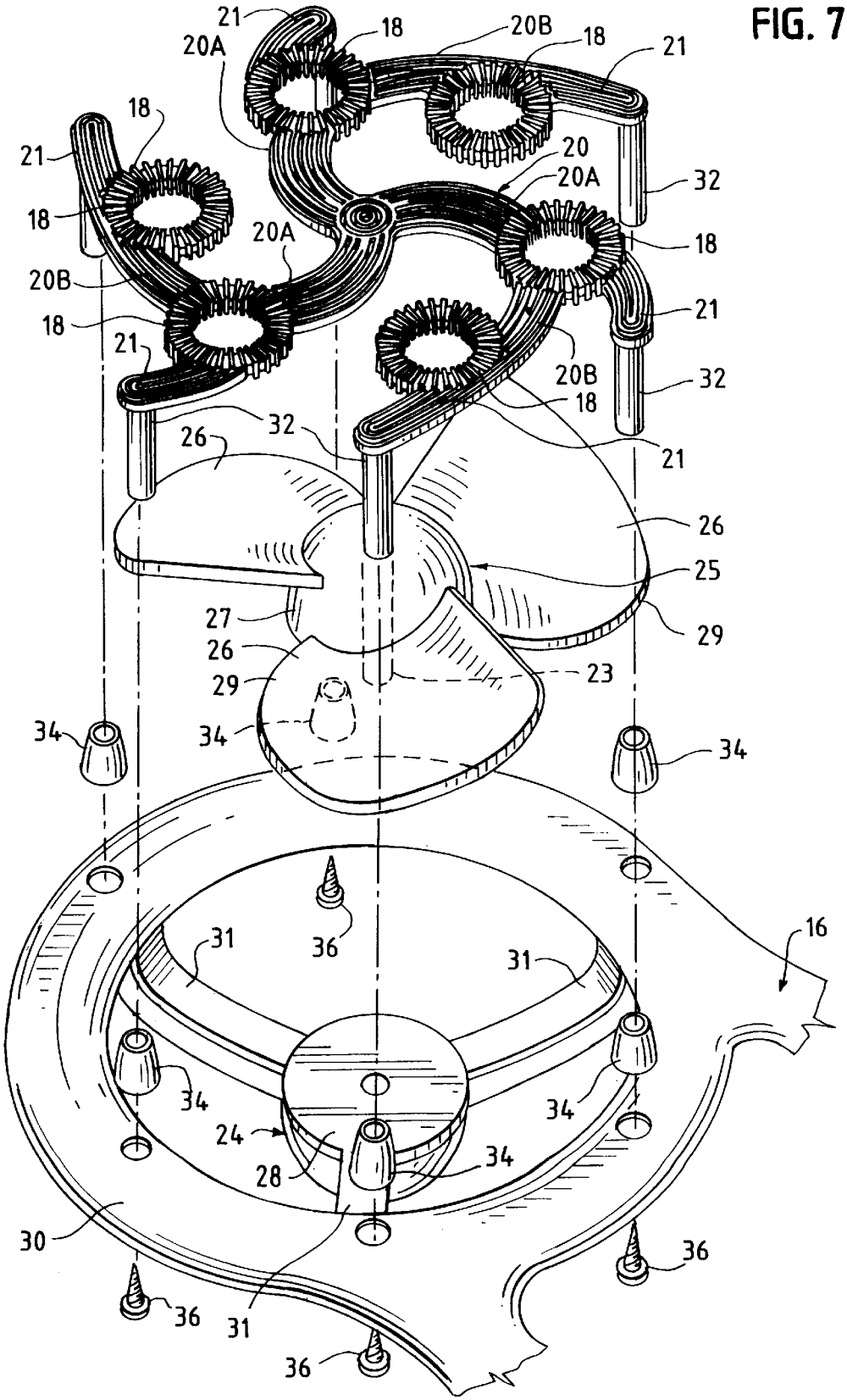
FIG. 7 is an exploded, perspective view of the bubble wand, fan blades and housing of the bubble maker toy of FIG. 1.

In operation, bubble solution, such as a soap solution, is dispensed into the dipping dish 42. As shown in FIGS. 1, 2 and 5, the bubble maker toy 10 is then placed in the dipping dish 42 with the bubble wand 12 face-down such that the bubble wand 12 is immersed in bubble solution. The bubble solution, which is of a suitable viscosity and surface tension to create an adherent layer on the bubble wand 12, clings to the bubble wand 12 as the bubble wand 12 is removed from the dipping dish 42.

The bubble solution forms a film on the bubble wand 12 covering the inner area of each bubble ring 18. The spaces between the raised ridges 22 form reservoirs that store additional bubble solution. Once the bubble maker toy 10 is removed from the dipping dish 42, the bubble wand 12 is preferably turned face-up and the electric fan 14 is activated by pressing one of the activation switches 40.

Activation of the electric fan 14 causes the fan blades 26 to rotate creating an air flow through the bubble wand 12 and through the bubble rings 18. As air flows through the bubble rings 18, the bubble solution films fill with air and break away from the bubble rings 18 forming bubbles. As bubbles break away from the bubble rings 18, the stored bubble solution is drawn from the reservoirs formed by the raised ridges 22 on the bubble rings 18 and connection arms 20 to form additional films on each bubble ring 18. These additional films also fill with air and form bubbles. In this manner, bubble streams are produced by each of the bubble rings 18 until substantially all of the bubble solution transferred to the bubble wand 12 during dipping has been used.

Due in part to the shape and configuration of the fan blades 26, particularly the inwardly curved upper, outer fan blade edges 29, the air flow generated by the electric fan 14 tends to concentrate in the area adjacent to the central hub 27 of the fan blade assembly 25 and center of the bubble wand 12. The shape of the connection arms 20 causes the airflow to swirl in a rotating manner. This swirling airflow pattern and the effect of the fan blade configuration forces the bubble streams outward from the center of the bubble wand 12 and away from each other. In this manner, the bubble streams are prevented from sticking together or combining to form one cluster of bubbles. Additionally, the bubble streams are blown in an entertaining swirling pattern by the airflow.

It will be apparent to those skilled in the art that modifications may be made without departing from the spirit and scope of the invention. Accordingly, it is not intended that the invention be limited except as may be necessary in view of the appended claims.

What is claimed is:

1. A bubble maker toy for simultaneously producing a plurality of bubble streams from a liquid bubble solution, the bubble maker toy comprising:

a bubble wand having a center and an outer circumference, said bubble wand including a plurality of bubble rings arranged around and adjacent said outer circumference, each bubble ring being adapted simultaneously to generate a bubble stream from the liquid bubble solution; and air flow means mounted with said bubble wand and underlying said bubble wand for producing an air flow through said bubble wand and through all of said bubble rings and which simultaneously produces a bubble stream at all of said plurality of bubble rings said air flow means being configured for forcing said bubble streams outwardly and away from each other.

2. The bubble maker toy of claim 1 wherein said air flow means comprises fan blades configured for producing an air flow which is concentrated adjacent to the center of said bubble wand for forcing said bubble streams outwardly.

3. A bubble maker toy for simultaneously producing a plurality of bubble streams from a liquid bubble solution, the bubble maker toy comprising a bubble wand having a center and an outer circumference, said bubble wand including a plurality of bubble rings arranged adjacent said outer circumference, each bubble ring being adapted to generate a bubble stream from the liquid bubble solution, and air flow means mounted with said bubble wand and underlying said bubble wand for producing an air flow through said bubble wand and through said bubble rings and which produces a bubble stream at each bubble ring, said air flow means being configured for forcing said bubble streams outwardly and away from each other, and wherein said bubble wand further comprises connection arms which connect said bubble rings together, said connection arms being arcuate in shape and being connected to each other adjacent the center of said bubble wand such that the air flow produced by said air flow means flows through said connection arms causing said air flow to swirl and forcing said bubble streams outwardly and away from each other.

4. The bubble maker toy of claim 3, and wherein said air flow means is a rotatably mounted fan having a plurality of fan blades, and motor means for driving said fan in one of a clockwise or counterclockwise direction, and wherein said connection arms have a curvature in the same direction as said fan is driven.

5. The bubble maker toy of claim 3, and wherein said connection arms comprise first segments joined adjacent the center of said bubble wand and each terminating outwardly adjacent one of said bubble rings and second segments, each of said second segments being joined to one of said bubble rings and extending to a said second of said bubble rings whereby all of said bubble rings are connected together.

6. The bubble maker toy of claim 1 further comprising ridges on said bubble rings which form reservoirs for said bubble solution.

7. The bubble maker toy of claim 3 further comprising ridges on said connection arms which form reservoirs for said bubble solution.

8. A bubble maker toy for simultaneously producing a plurality of bubble streams from a liquid bubble solution, the bubble maker toy comprising a bubble wand having a center and an outer circumference, said bubble wand including a plurality of bubble rings arranged adjacent said outer circumference, each bubble ring being adapted to generate a bubble stream from the liquid bubble solution, and air flow means mounted with said bubble wand and underlying said bubble wand for producing an air flow through said bubble wand and through said bubble rings and which produces a bubble stream at each bubble ring, said air flow means being configured for forcing said bubble streams outwardly and away from each other, and wherein said air flow means comprises an electric fan having a plurality of fan blades mounted for rotation about a central axis, said fan blades having upper, outer edges which curve inward toward said central axis for producing an air flow which is concentrated adjacent to the center of said bubble wand.

9. The bubble maker toy of claim 8 wherein said plurality of fan blades are comprised of a soft foam material.

10. The bubble maker toy of claim 8 wherein said bubble rings are positioned closely adjacent to said upper, outer edges of said fan blades as said fan blades rotate.

11. The bubble maker toy of claim 8 further comprising a housing including a handle, said electric fan and said bubble wand being connected to said housing.

12. The bubble maker toy of claim 11 further comprising a switch means positioned on said handle for activating said electric fan.

13. The bubble maker toy of claim 12 wherein said switch means comprises a pair of spaced apart activation switches mounted at spaced locations on said handle.

14. The bubble maker toy of claim 12 further comprising a bubble solution dipping dish for holding said bubble solution, wherein said bubble wand is dipped into said bubble solution held in said dipping dish prior to activating said electric fan, said dipping dish including a sidewall having a pouring spout.

15. A handheld bubble maker toy for producing soar bubbles from a liquid soap bubble solution, the bubble maker toy comprising a bubble wand having at least one bubble ring, and an electric fan mounted with said bubble wand and having a plurality of fan blades configured to rotate about a central axis to create an air flow through said bubble wand and through said at least one bubble ring, said fan blades being comprised of a pliable soft foam material for preventing injuries, wherein the bubble solution is of suitable viscosity and surface tension to cling to said bubble wand forming a film across said at least one bubble ring such that said air flow through said bubble wand and through said bubble rings produces soap bubbles from said bubble solution, and wherein said bubble wand has a center and an outer circumference and further comprises a plurality of bubble rings arranged adjacent said outer circumference such that said bubble maker toy is configured to produce a plurality of bubble streams from said plurality of bubble rings, each bubble ring being adapted to generate a bubble stream from the liquid soap solution, and wherein said electric fan is configured to produce an air flow concentrated adjacent to the center of said bubble wand for forcing said plurality of bubble streams outward from the center of said bubble wand and away from each other, and wherein said fan blades further having upper, outer edges which curve inward toward said central axis for producing said air flow concentrated adjacent to the center of said bubble wand.

16. The bubble maker toy of claim 15 further comprising connection arms which connect said plurality of bubble rings together, said connection arms being arcuate in shape and being connected to each other adjacent the center of said bubble wand such that the air flow produced by said electric fan flows through said connection arms causing said air flow to swirl in a rotating manner further forcing said bubble streams outward from the center of said bubble wand and away from each other.

17. The bubble maker toy of claim 16 wherein said fan blades are configured to rotate in one of a clockwise or counterclockwise direction, and wherein said connection arms have a curvature in the same direction as the fan blade rotation direction.

18. The bubble maker toy of claim 16 further comprising ridges on said plurality of bubble rings and said connection arms which form reservoirs for holding said bubble solution.

* * * * *